US006659018B1

(12) United States Patent
Jackson

(10) Patent No.: US 6,659,018 B1
(45) Date of Patent: Dec. 9, 2003

(54) STOP MECHANISM WITH DUAL PAWLS FOR GEAR OPERATED DOOR

(75) Inventor: Robert Jackson, Coloma, MI (US)

(73) Assignee: YSD Industries, Inc., Youngstown, OH (US)

( * ) Notice: Subject to any disclaimer, the term of this patent is extended or adjusted under 35 U.S.C. 154(b) by 0 days.

(21) Appl. No.: 10/108,736

(22) Filed: Mar. 28, 2002

(51) Int. Cl.[7] ..... B61D 17/00

(52) U.S. Cl. ..... 105/404; 105/355; 49/220; 292/201

(58) Field of Search ..... 49/220, 219, 218, 49/280; 105/378, 404, 258, 280, 406.1, 310, 355; 292/201, 199, 341.16, DIG. 32; 192/8, 15, 16, 19

(56) References Cited

U.S. PATENT DOCUMENTS 1,133,332 A * 3/1915 Standfest ..... 292/195
3,332,168 A * 7/1967 Madland ..... 49/220
3,555,731 A * 1/1971 Ross, Jr. ..... 49/210
3,660,938 A * 5/1972 Ross et al. ..... 49/220
4,262,933 A * 4/1981 Fox ..... 280/802
4,920,894 A * 5/1990 Thoman ..... 105/378
5,269,195 A * 12/1993 Kitagawara

* cited by examiner

*Primary Examiner*—S. Joseph Morano
*Assistant Examiner*—Frantz F. Jules
(74) *Attorney, Agent, or Firm*—Fay, Sharpe, Fagan, Minnich & McKee, LLP

(57) ABSTRACT

An anti-spin or stop mechanism for a railway car door includes a rotatable ratchet wheel having radially outward extending teeth on the outer circumferential surface, and first and second pawls mounted in side-by-side relation on a common pivot pin for engaging the ratchet wheel teeth. The ratchet wheel is commonly mounted on a shaft with a lever or handle used to activate a drive mechanism for partially opening or fully closing the door. The pawls are continuously urged toward engagement with the ratchet wheel so that one of the pawls is always disposed in engagement with a ratchet wheel tooth while the other pawl rests against a land between two adjacent teeth. Each tooth has a leading edge and a trailing edge configured so that the pawls may act against the teeth trailing edges to prevent movement of the ratchet wheel in one direction of rotation while permitting rotation over the leading edges in the other direction of rotation.

26 Claims, 6 Drawing Sheets

STOP MECHANISM WITH DUAL PAWLS FOR GEAR OPERATED DOOR

BACKGROUND OF THE INVENTION

The present invention relates generally to the art of railway cars. More particularly, the invention pertains to anti-spin or stop mechanisms for gear operated doors for railway cars.

The invention is particularly applicable to rectangular metal doors of the type used on railway freight cars and will be particularly described with reference thereto. However, it will be appreciated by those skilled in the art that the invention has broader applications and is adaptable to use with doors of other types and in other environments.

Rectangular metal doors of a known type used in railway cars include a generally rectangular frame typically comprised of top, bottom, and horizontal stiffeners, and opposed side members. Metal panels are secured to these frame members for completing the basic door construction. In most conventional railway cars, the frame members and metal panels are riveted and/or welded together.

Railway car doors are typically classified as either sliding doors or plug doors. Of the two, sliding doors are less complex, having a door configured to slide back and forth within a side panel of a railway car to selectively open and close an opening defined therein. Plug doors are more complex in that they are configured to first move laterally out of the opening defined in a railway car and then move longitudinally along a track disposed adjacent the railcar side panel.

Plug doors to be mounted on the side of a rail car include a series of panels or sheeting reinforced by horizontally disposed channels at the top, bottom and/or intermediate portions of the door. A pair of vertically oriented elongated support members such as pipes, rods or bars are configured to support the door on the railcar. The support members are typically provided with upper and lower cranks attached to the terminal end areas thereof which serve as lever arms for laterally moving the door into and out of the railcar door opening. Upon actuation of a driving mechanism, such as a manually operated gear assembly, the support members are rotated for causing a corresponding rotation of the cranks. Rotation of the cranks, in turn, draws the door laterally outward from the opening until the door is supported on a track disposed adjacent to the side of the railcar. The door is movably supported on the track by roller hangers which enable the door to slide longitudinally along the side of the railcar.

One problem that occurs when the door is completely closed is that if a load falls against the inside wall of the door, an operating lever which controls movement of the door may spin and possibly move the door into an unwanted slightly or fully opened position.

A second problem occurs when the door is in the fully opened position. The support members have a tendency to rotate, thus causing the door to drift back into the side of the railcar. If this occurs, the ability of the door to slide longitudinally along the track may be inhibited. Furthermore, the door or the side of the railcar may become damaged because of the drifting action.

Another problem that occurs with existing railway car doors is that only one pawl is used to engage a ratchet to prevent rotation. Under certain conditions, the operating lever could still spin in spite of the pressure of a ratchet and pawl if the lever releases too fast and does not allow the pawl to engage the ratchet. This condition would occur if large forces were tending to push the door open and the operator released the lever while a rotational force was operating thereon with the pawl positioned on a peak of a ratchet tooth.

Accordingly, it has been considered desirable to develop an anti-spin arrangement for a gear operated door which would overcome foregoing difficulties and others while providing better and more advantageous overall results.

SUMMARY OF THE INVENTION

In accordance with the present invention, an anti-spin or stop mechanism with dual pawls for a gear operated planar door is advantageously provided. The door is of the type having at least one elongated support member rotatably mounted thereto and which is selectively rotated through a drive mechanism by an operating mechanism to achieve door opening and closing. The operating mechanism includes an actuating member, such as a handle, lever or the like, which facilitates selective rotation of the at least one support member. An anti-spin mechanism operatively communicates with the operating mechanism to prevent undesired spinning of the operating mechanism which might otherwise allow the door to shift in an uncontrolled manner from one position to another.

According to another aspect of the invention, the anti-spin or stop mechanism includes a pair of stop members configured and positioned so that one or the other of the stop members will always be in stopping relation to the operating mechanism to thereby prevent undesired spinning of the operating mechanism.

According to yet another aspect of the invention, the anti-spin or stop mechanism includes a rotatable ratchet wheel engageable by stop members to prevent rotation of the operating mechanism in a manner otherwise allowing for undesired movement of the door from a closed toward an opened position.

In accordance with a more limited aspect of the invention, the operating mechanism and ratchet wheel are mounted on a common shaft for joint rotation during door opening and closing, and the pair of stop members comprise first and second pawls positioned such that one pawl may always be in stopping engagement with a toothed area on the periphery of the ratchet wheel.

In accordance with still another limited aspect of the invention, the first and second pawls are mounted on a common pivot point or shaft.

According to a further aspect of the invention, an anti-spin/anti-drift or stop mechanism is advantageously provided and includes a pair of rotatable ratchet wheels each engageable by stop members to prevent either undesired spinning of the operating mechanism or undesired drifting of the railcar door.

A principal advantage of the present invention resides in a provision of an anti-spin or stop arrangement which prevents an operating lever of a door from spinning if a load falls or is otherwise applied against an inside surface of the door.

Another advantage of the invention is found in an anti-spin or stop arrangement which does not impede or interfere with normal door operation.

Yet another advantage of the invention resides in the provision of an anti-spin or stop arrangement which is relatively low in cost.

Yet still another advantage of the invention is the provision of an anti-spin or stop arrangement which is easy to manufacture and retrofit to existing doors.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
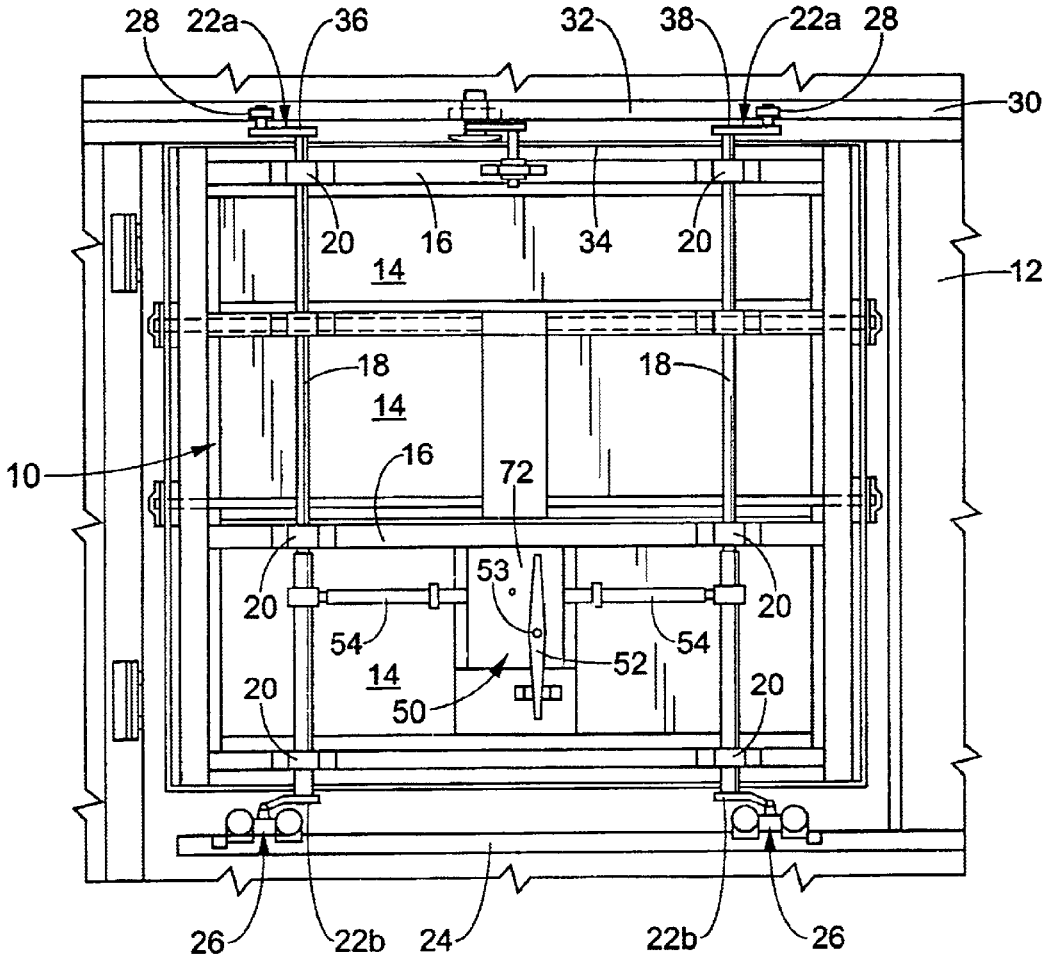
FIG. 1 is front elevational view of a plug type railway car door which includes an anti-spin or stop arrangement formed in accordance with a preferred embodiment of the present invention.

Referring now to the drawings wherein the showings are for purposes of illustrating a preferred embodiment of the invention only and not for purposes of limiting same, FIG. 1 shows a plug-type railcar door 10 of the type with which the subject invention is particularly useful disposed in an opening 12 in a railcar. The door includes a wall of paneling or sheeting 14 reinforced with horizontal channels 16 extending across top, bottom and intermediate portions of the sheeting. Paneling 14 is typically fabricated from metal.

The door 10 is supported by elongated support members 18, such as pipes, rods or tubes, which are disposed along the vertical height of the door. These support members are rotatably mounted to the horizontal reinforcing channels 16 at the outer surface of the door by brackets or fulcrums 20 located adjacent to the door side edges for retaining the support members in a vertical disposition.

Each of the support members 18 includes a first or upper end having a first or upper crank 22*a* and a second or lower end having a second or lower crank 22*b* operatively connected thereto. The cranks 22*a*, 22*b* serve as lever arms which enable the door to move laterally into and out of the railcar opening 12. The door 10 is adapted to move laterally out of the door opening toward the outside of the railcar until the door is supported on a track 24 disposed adjacent the railcar sidewall. The door is then moved longitudinally along the side of the car on track 24 to effectively expose the door opening to facilitate car loading and unloading. Thus, when it is in the unplugged position, the door is movably supported on the track by roller hangers 26 which are attached to the ends of the lower cranks 22*b* for guiding the door in its longitudinal movement.

Upper ends of the cranks 22*a* include pins with rollers 28 mounted for longitudinal movement within and along a top retainer rail or longitudinal retainer member 30 having a generally U-shaped cross section. Retainer 30 is mounted along the top of the door opening 12 and functions to restrain the top of the door and prevent undesired displacement thereof. Rollers 28 move along an inner surface of a downwardly depending front flange 32 of the top retainer rail. The front flange extends longitudinally and is located inside an outer edge of a laterally outward extending lower flange 34 spaced from and located below the front flange. Horizontal connecting portions 36, 38 of upper cranks 22*a* extend through the space between front flange 32 and lower flange 34, and connect the upper end of the cranks and the rollers 28 with the upper end of the support members 18. The rollers 28 are disposed behind the retainer rail 30. The combination of the rollers and the retainer rail acts to restrain the top of the car door as it is moved longitudinally along the track 24.

As is well understood in the art, rotation of the support members 18 causes a corresponding outward rotation of the cranks 22*a*, 22*b* to sequentially draw the door 10 laterally outward from the door opening. An operating mechanism 50 is provided on the door for controlling the rotation of the support members 18 and the cranks in a manner well known in the art. An activating member 52 in the form of a lever or handle has a mounting opening 53 therethrough for securing same to the door operating mechanism.

Figure 2:
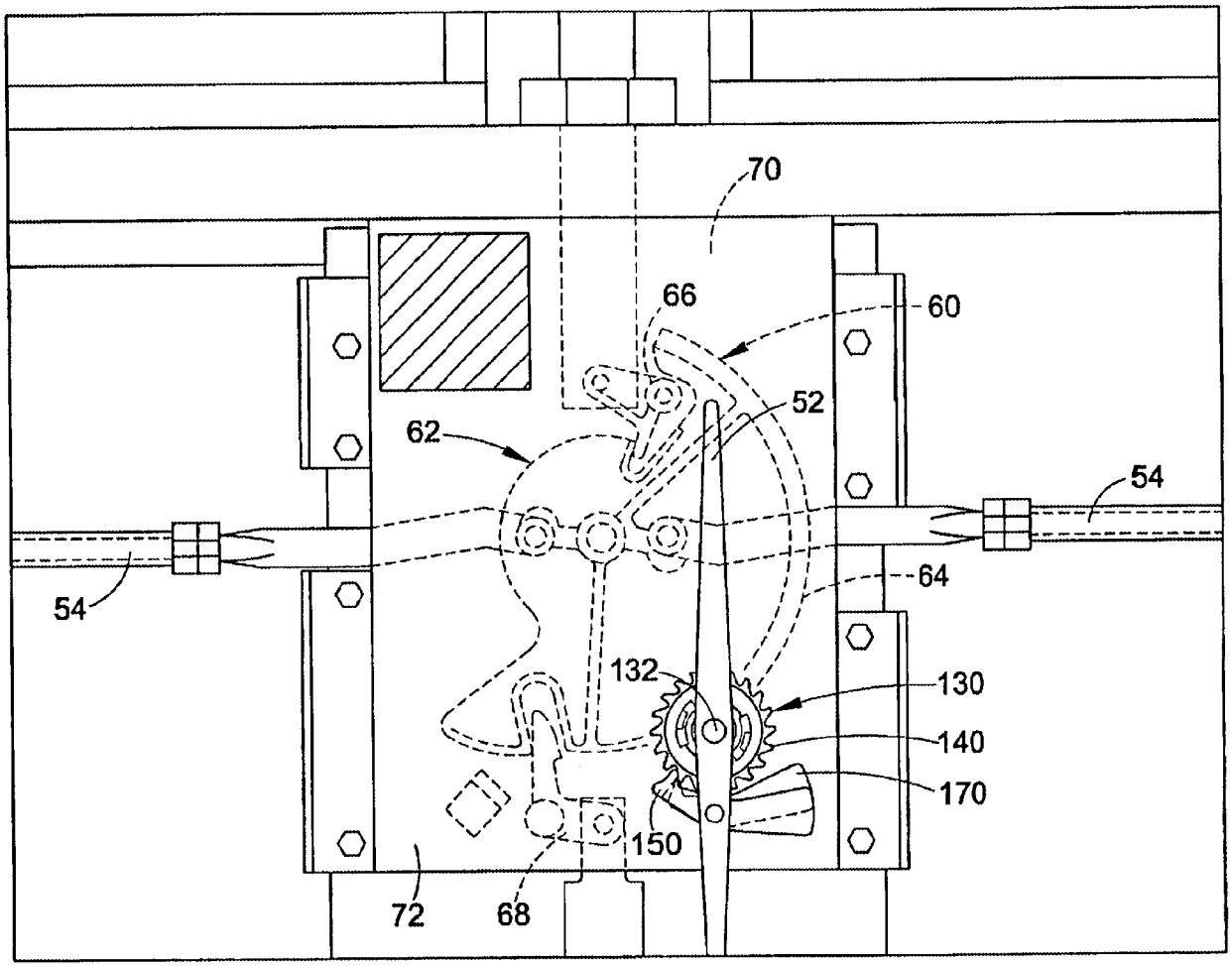
FIG. 2 is a front elevational view of a portion of the railcar door illustrating a drive gear mechanism and the anti-spin arrangement.

Referring to FIG. 2, a drive mechanism 60 preferably comprises a gear operated system or assembly 62 operatively connected to and actuated by actuating member or lever 52. The gear assembly includes a rotatably mounted gear segment 64 and two pivotally mounted operating cams 66, 68, each of which is housed in and positioned between a bearing plate 70 and a cover plate 72. The bearing plate 70 is mounted on a lower portion of the door sheeting 14, and the cover plate is bolted or otherwise secured to the bearing plate in laterally spaced apart relation thereto.

A pair of transmission members 54, such as pipes, rods or tubes, are connected at first ends to the gear segment 64 and at second ends to an associated support member 18. By rotating the lever or handle 52 counterclockwise, gear 64 is rotated clockwise which, in turn, pivots operating cams 66, 68. Rotation of the gear causes the transmission members 54 to rotate the support members 18 and cranks 22*a*, 22*b* and thereby effect selective lateral movement of the door outwardly from the opening 12 to the outside of the railcar, thereby unsealing or unplugging the railcar opening. When the lever or handle 52 is rotated clockwise, the gear segment rotates counterclockwise for moving the door into the railcar opening. The door thus seals or plugs the opening.

Figure 3:
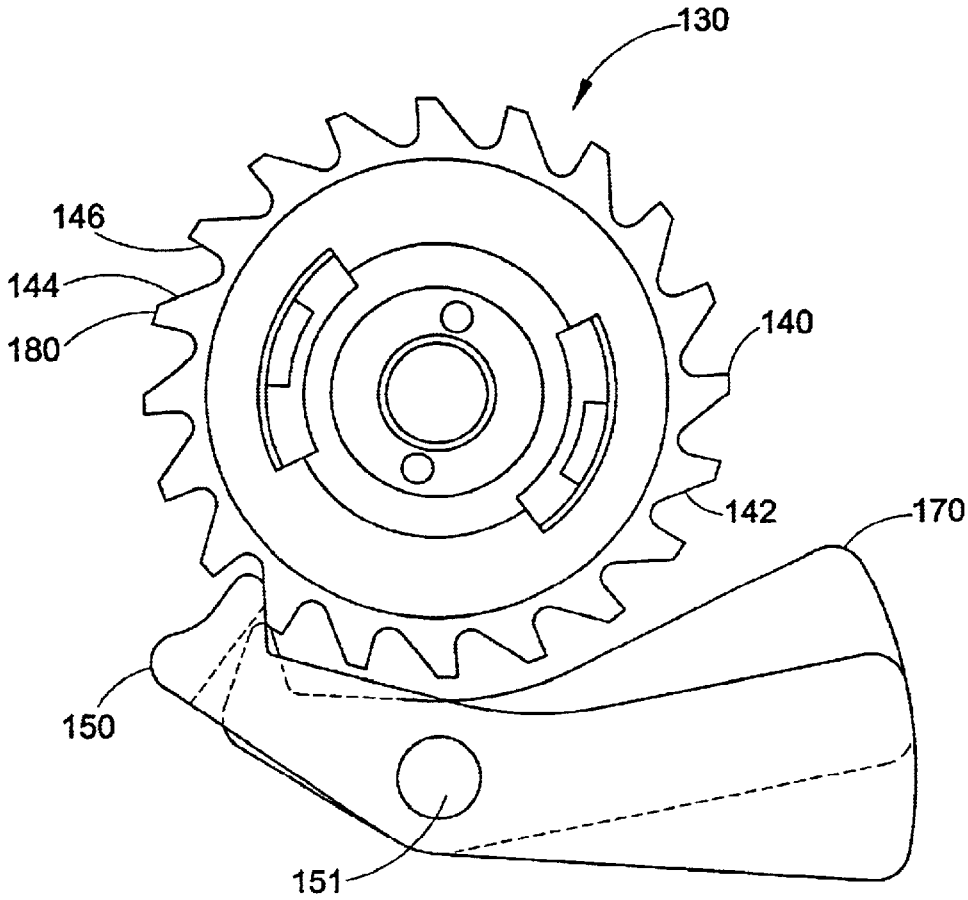
FIG. 3 is a side elevational view of the dual pawl mechanism of the present invention.

Referring to FIGS. 1, 2, and 3, an anti-spin mechanism 130 is disposed intermediate the bearing and cover plates 70, 72 and is operatively engaged during closing of the door. The anti-spin mechanism includes an operating shaft 132. Lever or handle 52 includes an opening 53 extending therethrough for allowing the lever to be received on the operating shaft 132. A locking or retaining device (not shown) securely retains the lever on the operating shaft and prevents any relative rotation therebetween.

Referring particularly to FIG. 3, the anti-spin mechanism includes a ratchet gear or wheel 140 which is positioned on and secured to the shaft 132 intermediate the cover and bearing plates. This ratchet wheel has a plurality of generally radial outwardly extending teeth 142 at spaced intervals circumferentially therearound. Each tooth has a leading edge 144 and trailing edge 146.

Figure 4A:
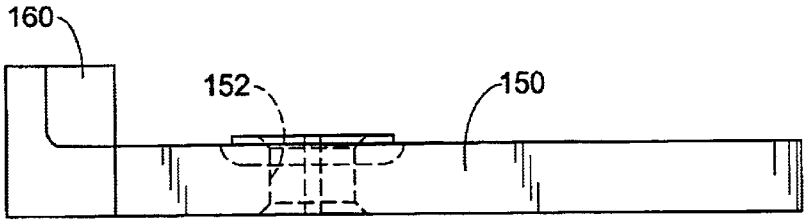
FIG. 4A is a top plan view of a first pawl of the dual pawl mechanism of FIG. 3.
Figure 4B:
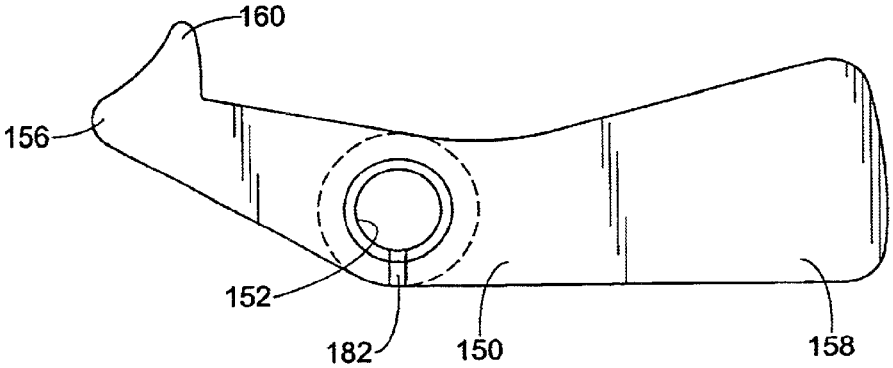
FIG. 4B is a side elevational view of a first pawl of the dual pawl mechanism of FIG. 3.

A first pawl 150 is pivotally interposed between the cover and bearing plates by means of a pivot pin 151 extending through a mounting hole or opening 152 therein. Referring also to FIG. 4A, the pawl 150 has a first end 156 and a second end 158 extending radially outward from opening 152. First end 156 has a tab or extension 160 as best shown in FIGS. 4A and 4B which is configured and dimensioned to engage the teeth 142 of the ratchet wheel. Such engagement is best shown in FIG. 3.

Continuing with reference to FIG. 3, and with reference also to FIG. 4B, a second pawl 170 includes a mounting hole or opening 172 for pivotally mounting the second pawl in a side-by-side relationship with first pawl 150 on pivot pin 151. Similar to the first pawl, pawl 170 has a first end 174 and a second end 176 extending radially of hole 172. Likewise, first end 174 has an extension or tab 178 configured and dimensioned to engage the teeth 142 of the ratchet wheel.

Pawl second ends 158, 176 are designed to have a greater weight or mass than pawl first ends 156, 174, respectively. As a result tabs 160, 178 are continuously urged toward engagement with teeth 142 of ratchet wheel 140. Other means such as springs and the like could also be used to achieve this same result.

The pawls 150, 170 allow the ratchet wheel to rotate freely during closing of the door when the operating lever 52 and ratchet wheel 140 are rotated clockwise in the view of FIG. 2. As best shown in FIG. 4, the radial length of first end 156 of the first pawl is greater than the length of first end 174 of the second pawl. This difference in length staggers tabs 160, 178 to ensure that one of the tabs is disposed in engagement with a ratchet wheel tooth substantially at all times.

To close the door, the lever 52 is rotated clockwise, thus rotating the ratchet wheel 140 clockwise. One of the tabs 160, 178 of either pawl 150 or pawl 170 engages the leading edge 144 of a ratchet tooth while the other of the tabs engages a peak 180 of a ratchet tooth. The tab engaging the leading edge slides along the edge until it contacts the peak of the tooth. Meanwhile, the other tab slips off of the peak of a ratchet tooth and engages a leading edge of the next adjacent tooth. As a result, one of the tabs is at all times in contact with a tooth leading edge.

During closing of the door, the lever or handle 52 is rotated one or more turns, thus rotating the shaft 132 and the gear segment 64 thus closing the door. If a load shifts or is otherwise applied to an internal wall of the door, the gear segment has a tendency to rotate clockwise, thus attempting to cause the lever 52 to spin out of control counterclockwise and cause a potentially dangerous situation. That is, once the gear segment begins to rotate for opening the door, the lever will also commence to spin.

The subject invention, however, recognizes these dangerous circumstances and provides a solution to same which is simple and inexpensive, and which may be retrofit to existing railcar doors. That is, as the ratchet wheel is urged to rotate or spin counterclockwise, one of tabs 160, 178 of pawls 150, 170 will engage trailing edge 146 of its associated tooth and thereby prevent rotation. Moreover, because of the relative positioning of tabs 160, 178, one of the tabs will always be in engagement with a tooth trailing edge 146 so that uncontrolled spinning is incapable of commencing. This arrangement is a significant improvement over prior devices which employed a single pawl which did not always catch on a tooth or other member as spinning commenced. The invention allows for an anti-spin arrangement for a gear operated door where a stopping pawl is at all times in stopping relation to a ratchet wheel or gear employed in the door opening and closing mechanism.

Figure 4C:
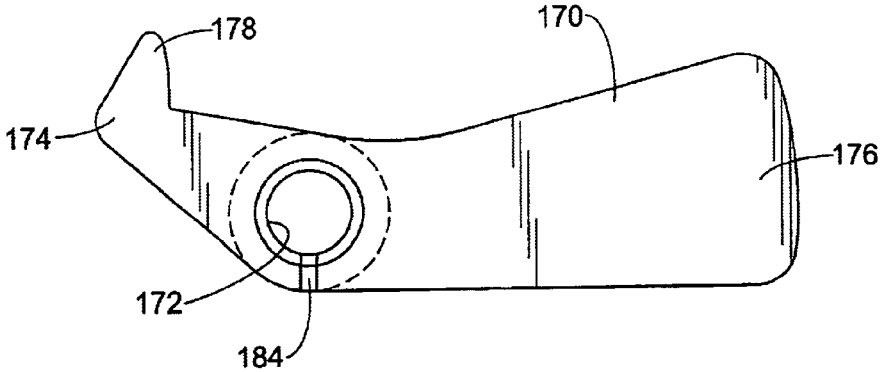
FIG. 4C is a side elevational view of a second pawl of the dual pawl brake mechanism of FIG. 3.

Referring to FIGS. 4B and 4C, each pawl also includes a groove 182, 184, respectively, extending radially outward from mounting openings 152, 172. Those grooves allow for any debris that builds up between the pawls and pivot pin 151 to be discharged or fall out. Such accommodation enhances the ability of the pawls to freely pivot on pin 151 and reliably function in their intended manner.

Figure 5:
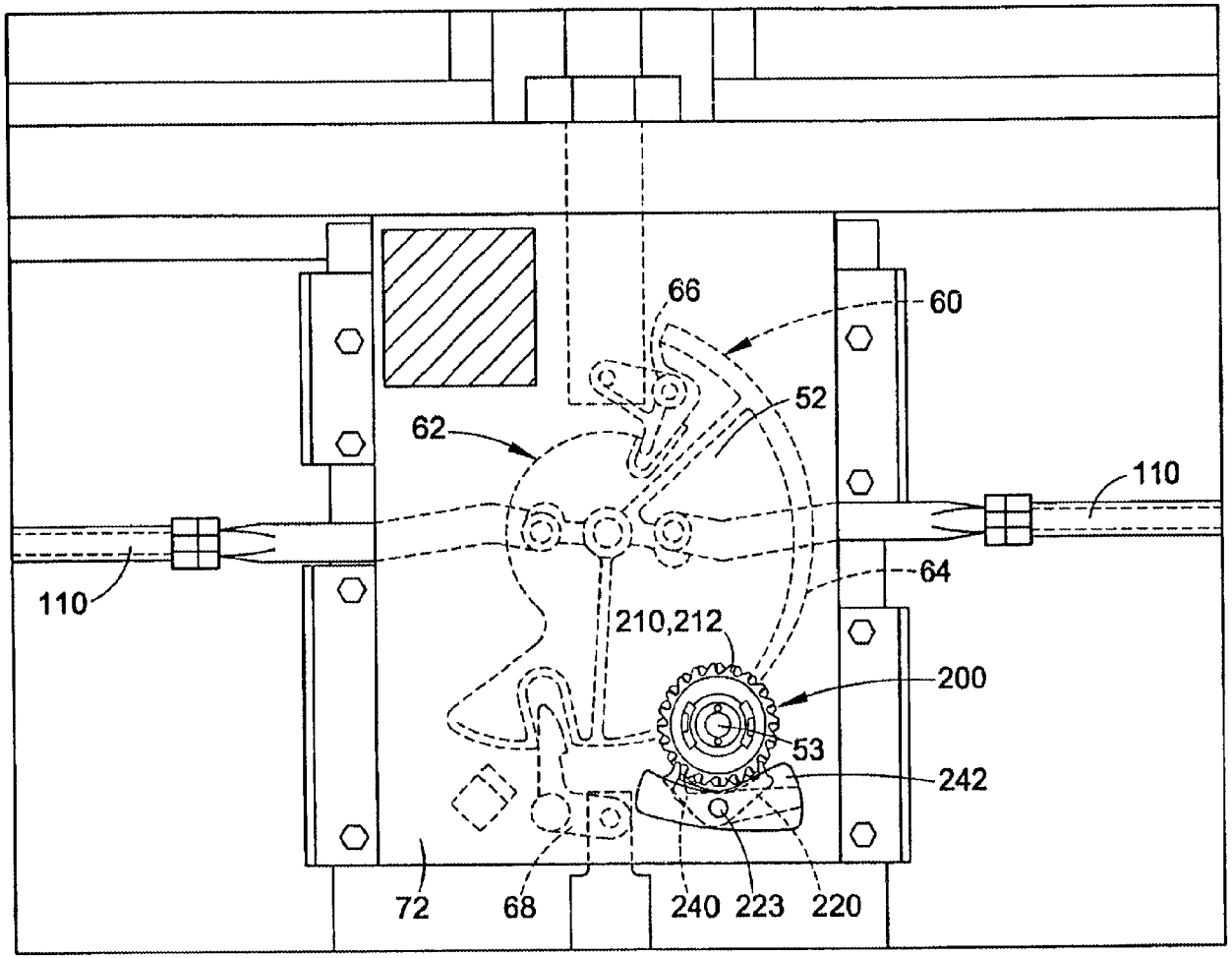
FIG. 5 is a front elevational view of a plug type railway car door which includes an anti-spin and anti-drift arrangement formed in accordance with a second preferred embodiment of the invention.
Figure 6B:
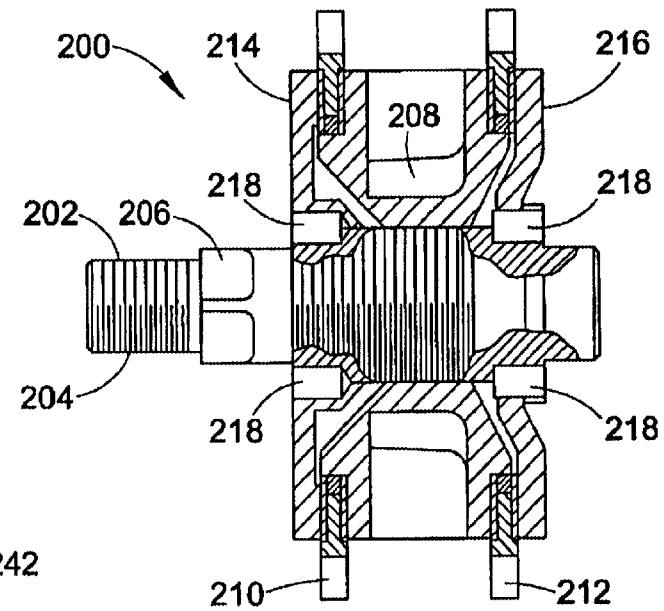
FIG. 6A is an enlarged elevational view of the anti-spin and anti-drift mechanism shown in FIG. 5; and, FIG. 6B is a cross-sectional view taken along lines A—A of FIG. 6A.
Figure 6A:
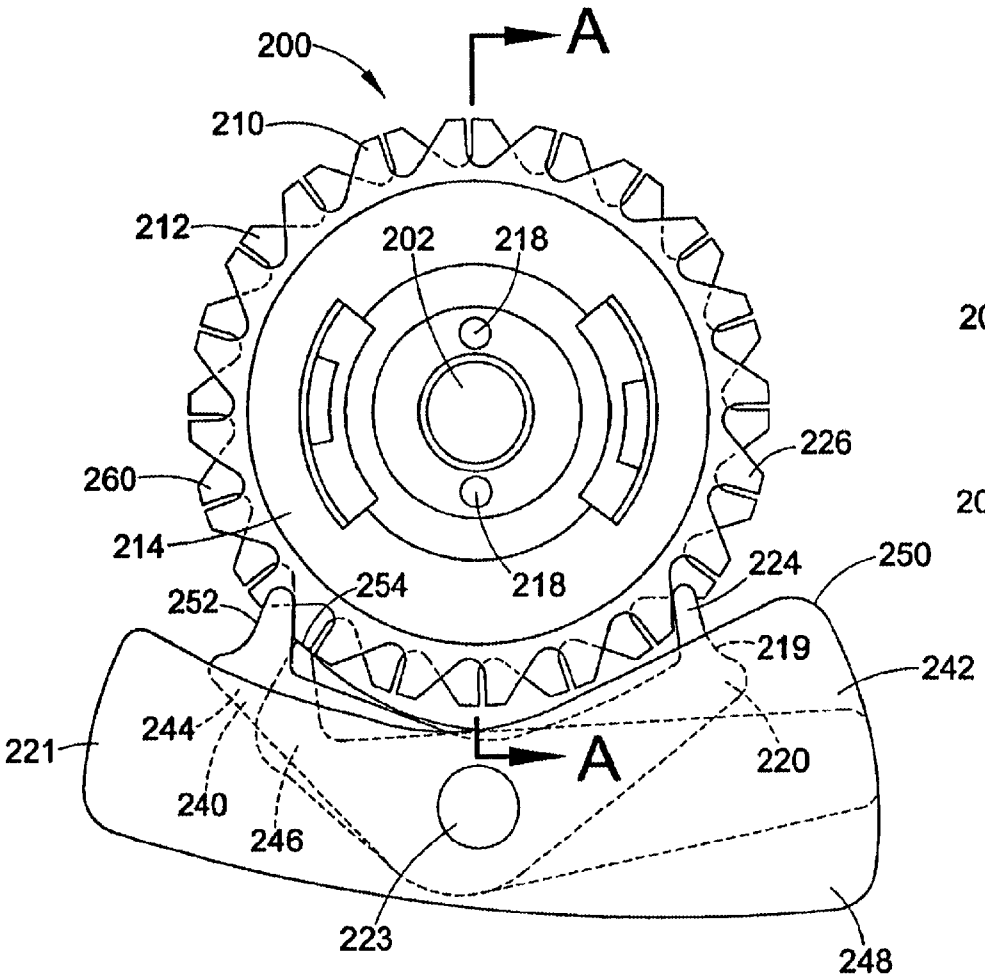

Referring now to FIGS. 5, 6A and 6B, a second preferred embodiment of a stop mechanism is shown as involving an anti-spin/anti-drift mechanism 200 in place of the stop mechanism 130 of the first embodiment. The anti-spin/anti-drift mechanism uses the same general concept as described above and is advantageously positioned between the cover and bearing plates. There, an operating shaft 202 of the mechanism has a portion 204 which is threaded through an opening in the cover plate. Operating lever 52 (FIG. 1) is secured to the anti-spin/anti-drift mechanism by inserting a shoulder 206 on the operating shaft 202 through opening 53 of the lever. A locknut or other suitable device (not shown) retains the lever on the operating shaft.

The anti-spin/anti-drift mechanism further includes a pinion segment 208 which is interposed between a pair of ratchet assemblies or wheels 210, 212. Ratchet assembly 210 prevents undesired drifting of the railcar door while ratchet assembly 212 prevents undesired spinning of the lever.

The pinion segment has a through opening which threadedly receives the shaft 202. The pinion member can then move or shift along the shaft between the two ratchet assemblies. Ratchet assembly 210 is positioned along a first end of the shaft 202 adjacent the cover plate, and ratchet assembly 212 is positioned along a second end of the shaft adjacent the bearing plate such that the assemblies are disposed in generally parallel spaced relation to each other. Flanges 214, 216 (FIG. 6B) are disposed adjacent opposite faces of the ratchet assemblies 210, 212 and retained in position on the operating shaft by means of pins 218.

A pawl 220 is pivotably disposed adjacent the cover plate by means of a pivot pin 223. This pawl has a first end 219 and a second end 221 extending radially outward of the pivot pin. First end 219 has a tab or extension 224 configured and dimensioned to engage teeth 226 of the ratchet wheel 210. Pawl second end 221 is designed to have a greater weight or mass than the pawl first end 219. Thus, the tab 224 is continuously urged toward engagement with teeth 226.

If opening of the door is desired, the lever 52 is manually rotated counterclockwise, thus rotating the pinion toward ratchet wheel 210 until it bottoms out against flange 214. The pinion then engages ratchet assembly 210, and the ratchet 210 and pinion rotate counterclockwise until the door is fully opened. Tab 224 of pawl 220 engages one of teeth 226, and the pawl allows only counterclockwise rotation. Referring to FIG. 1, once the door is opened and moved on the track 24, the support members 18 have a tendency to rotate, thus rotating the cranks 22*a*, 22*b* and thereby potentially allowing the door to move toward the side of the railcar. If the gear starts to rotate counter-clockwise to close the door, the ratchet and pawl act to prevent rotation. Undesired drifting of the door into the side of the railcar is thereby prevented.

During door closure, the lever 52 is rotated clockwise, thus rotating the shaft 202 and the pinion 208 toward the flange 216 until the pinion bottoms out. The pinion then rotates the gear segment, thus closing the door. The pinion also engages or clamps onto the ratchet assembly 212. A set of pawls 240, 242 are pivotally disposed in a side-by-side relationship adjacent the bearing plate via pivot pin 223, and engage ratchet assembly 212 in a manner which allows the ratchet to rotate clockwise during door closing. However, the pawls 240, 242 prevent ratchet rotation in the opposite direction, thus preventing spinning of the lever. If a load is applied to an internal wall of the door, the gear segment has a tendency to rotate, thus attempting to force the pinion 208 to also rotate and thereby possibly cause the lever 52 to spin out of control and cause a dangerous or damaging situation. However, the pinion would then bottom out against flange 214 faster than the lever can spin or rotate to thus prevent the occurrence of a dangerous or damaging situation.

As with pawl 220, pawls 240, 242 each have first ends 244, 246 and second ends 248, 250. First ends 244, 246 have tabs 252, 254 configured and dimensioned to engage teeth 260 of ratchet wheel 212. The pawl second ends 248, 250 have a greater weight or mass than first ends 244, 246 to ensure that tabs 252, 254 are continuously urged toward engagement with teeth 260 of ratchet 212.

The radial length of the first end 244 of pawl 240 is greater than the length of first end 246 of second pawl 242 to stagger the tabs 252, 254 to thus ensure that one of the tabs is in engagement with a ratchet wheel tooth substantially at all times. As the ratchet is urged to spin or rotate counterclockwise, one of the tabs 252, 254 will engage a trailing edge of its associated ratchet tooth and the other tab will engage a peak of an adjacent ratchet tooth. As with the first embodiment, one of the tabs is at all times in contact with a tooth leading edge so that rotation is effectively prevented.

The invention has been described with reference to preferred embodiments. Obviously, modifications and alterations will occur to others upon a reading and understanding of the specification. The invention is intended to include all such modifications and alterations insofar as they come within the broad meaning and scope of the appended claims.

Having thus described the preferred embodiments, the invention is now claimed to be:

1. The A railcar door assembly comprising:

a substantially planar door;

at least one elongated support member rotatable mounted to said door;

a drive mechanism associated with said door and operatively connected to said support member for selectively rotating said support member about its length to partially open or fully close said door; and, a stop mechanism associated with said door for preventing movement of said drive mechanism when said door is in one of a partially opened and fully closed position, said stop mechanism including a first rotatable mounted ratchet wheel and first and second pawls for selective alternating engagement with said ratchet wheel to selectively prevent movement of said ratchet wheel in one direction of rotation;

said ratchet wheel having a plurality of teeth extending radially outward from the outer peripheral surface thereof, and said first and second pawls are configured and dimensioned to engage selected ones of said teeth; and, wherein each of said first and second pawls has first and second ends with said first ends disposed for engagement with said ratchet wheel teeth such that when the first end of one pawl is in engagement with one of said ratchet wheel teeth the first end of the other pawl is disengaged from said one of said ratchet wheel teeth.

2. The railcar door assembly of claim 1 wherein said first and second pawls are disposed in side-by-side relation to a common pivot pin.

3. The railcar door assembly of claim 1 wherein said drive mechanism includes a gear segment selectively rotatable for rotating said elongated member, said ratchet wheel and a handle for rotating said gear segment being mounted for rotation on a common shaft.

4. The railcar door assembly of claim 1 wherein said first ends of said pawls each include a distinct tab for selective engagement with said ratchet wheel teeth.

5. The railcar door assembly of claim 1 wherein each of said ratchet wheel teeth has a leading edge and a trailing edge, the first ends of said pawls selectively preventing rotation of said ratchet wheel against said trailing edges while allowing rotation against said leading edges.

6. The railcar door assembly of claim 5 wherein the first ends of said pawls are dimensioned and configured so that when the first end of one pawl is engaged with said one of said ratchet wheel teeth the first end of other of said pawls engages an outermost land area of a tooth adjacent said one of said ratchet wheel teeth.

7. The railcar door assembly of claim 1 wherein each of said first and second pawls has first and second ends with said first ends continuously urged toward engagement with said ratchet wheel.

8. The railcar door assembly of claim 7 wherein the second end of each pawl has a greater weight than its respective first end so that said pawls are continuously urged to pivot around said pivot pin toward engagement with said ratchet wheel.

9. The railcar door assembly of claim 1 further including a second ratchet wheel having a plurality of teeth extending generally radially outward from the outer circumference thereof and mounted to said railcar door in spaced relation to said first ratchet wheel.

10. The railcar door assembly of claim 9 wherein a third pawl is disposed for selective operative engagement with said second ratchet wheel teeth for selectively preventing undesired movement of said second ratchet wheel in one direction of rotation.

11. The railcar door assembly of claim 10, wherein said third pawl has a first end and a second end, said third pawl first end including a portion for selective engagement with said second ratchet wheel teeth.

12. The railcar door assembly of claim 10, wherein said third pawl is mounted in spaced relation to said first and second pawls on a common pivot pin.

13. A railcar door assembly comprising:

a substantially planar door;

at least one elongated support member rotatable mounted to said door;

a drive mechanism associated with said door and operatively connected to said support member for selectively rotating said support member about its length to partially open or fully close said door; and, a stop mechanism associated with said door for preventing movement of said drive mechanism when said door is in one of a partially opened and fully closed position, said stop mechanism including a first rotatable mounted ratchet wheel and first and second pawls disposed in a side-by-side relation for selective alternating engagement with said ratchet wheel to selectively prevent movement of said ratchet wheel in one direction of rotation; and, wherein each of said pawls includes a grooved area extending to the pawl outer extremity from a pivot pin mounting opening for preventing debris buildup between said pawls and said pivot pin.

14. A stop mechanism for a railcar door having a gear mechanism and a lever operatively connected thereto for rotating the gear mechanism to open and close the door, said stop mechanism comprising:

a ratchet wheel having a plurality of teeth extending generally radially from the outer circumference thereof and adapted for rotatable mounting to said railcar door;

a first pawl disposed for selective operative engagement with said ratchet wheel teeth;

a second pawl disposed for selective operative engagement with said ratchet wheel teeth; and, said first and second pawls being configured and dimensioned so that one of said pawls is always disposed in operative engagement with one of said ratchet wheel teeth for selectively preventing undesired movement of said ratchet wheel in one direction of rotation;

wherein each of said first and second bawls has first and second ends, said first ends each including a portion for selective engagement with said ratchet wheel teeth; and, said first and second pawls being mounted in side-by-side relation on a common pivot pin and wherein said first ends of said pawls are configured and dimensioned such that when the first end portion of one pawl is in engagement with a ratchet wheel tooth the first end portion of the other pawl is disengaged from said ratchet wheel teeth.

15. The stop mechanism of claim 14 wherein each of said ratchet wheel teeth has a leading edge and a trailing edge, said first end portions of said pawls selectively preventing rotation of said ratchet wheel against said teeth trailing edges while allowing rotation of said ratchet wheel against said teeth leading edges.

16. The stop mechanism of claim 15 wherein the first end portions of said first and second pawls are dimensioned and configured so that when the first end portion of one pawl is engaged with one of said ratchet wheel teeth the first end portion of the other pawl engages an outermost land area of a tooth adjacent said one of said ratchet wheel teeth.

17. The stop mechanism of claim 16 wherein said first and second pawls are continuously urged toward engagement with said ratchet wheel teeth.

18. The stop mechanism of claim 14 wherein the second end of each pawl has a greater weight than its respective first end so that said pawls are continuously urged to pivot around said pivot pin toward engagement with said ratchet wheel teeth.

19. The stop mechanism of claim 14 wherein each of said pawls includes a grooved area extending to the pawl outer extremity from a pivot pin mounting opening for preventing debris buildup between said pawls and said pivot pin.

20. A stop arrangement for a railcar door having a gear mechanism and a lever operatively connected thereto for rotating the gear mechanism to open and close the door, said stop arrangement comprising:

a ratchet wheel having a plurality of teeth extending generally radially outward at predetermined spaced intervals around the outer circumference thereof and adapted for rotatable mounting to said railcar door;

said ratchet wheel teeth each having a leading edge and a trailing edge with a land area disposed between the leading and trailing edges of adjacent teeth;

first and second pawls each having a first end portion disposed for selective alternating operative engagement with said ratchet wheel teeth; and, said first end portions of said first and second pawls being configured and dimensioned so that one of said first end portions is always disposed in operative engagement with one of said ratchet wheel teeth intermediate the leading and trailing edges thereof for selectively preventing undesired rotation of said ratchet wheel in a direction against the trailing edge of said one of said ratchet wheel teeth while the other first end portion engages one of said land areas.

21. The stop arrangement of claim 20 wherein said first and second pawls are mounted in side-by-side relation on a common pivot pin.

22. The stop arrangement of claim 21 wherein the first end portions of said first and second pawls are dimensioned and configured so that when the first end portion of one pawl is engaged with one of said ratchet wheel teeth the first end portion of the other pawl engages the land area of a tooth adjacent said one of said ratchet wheel teeth.

23. The stop arrangement of claim 20 wherein said first and second pawls are continuously urged toward engagement with said ratchet wheel teeth.

24. The stop arrangement of claim 23 wherein said each of said first and second pawls has a second end portion of greater weight that its respective first end portion and said pawls are pivotally mounted intermediate said first and second end portions such that said pawls are continuously urged to pivot toward engagement with said ratchet wheel teeth.

25. The stop arrangement of claim 24 wherein said first and second pawls are mounted in side-by-side relation on a common pivot pin.

26. A stop mechanism for a railcar door having a gear mechanism and a lever operatively connected thereto for rotating the gear mechanism to open and close the door, said stop mechanism comprising:

a first ratchet wheel having a plurality of teeth extending generally radially from the outer circumference thereof and mounted to said railcar door in a spaced relationship to said first ratchet wheel;

a second ratchet wheel having a plurality of teeth extending generally radially from the outer circumference thereof and adapted for rotatable mounting to an associated railcar door;

first and second pawls configured and dimensioned so that when one of said first and second pawls is in operative engagement with one of said first ratchet wheel teeth for selectively preventing undesired movement of said first ratchet wheel in a first direction of rotation the other of said first and second pawls is disengaged from said one of said first ratchet wheel teeth; and, a third pawl configured and dimensioned for selective operative engagement with one of said second ratchet wheel teeth for selectively preventing undesired movement of said second ratchet wheel in a second direction of rotation.

* * * * *